US009598894B2

(12) United States Patent
Raz

(10) Patent No.: US 9,598,894 B2
(45) Date of Patent: Mar. 21, 2017

(54) ARRANGEMENT FOR SECURING A PANEL CLOSURE

(71) Applicant: Dan Raz Ltd., Tirat Carmel (IL)

(72) Inventor: Amir Raz, Haifa (IL)

(73) Assignee: DAN RAZ LTD., Tirat Carmel (IL)

( * ) Notice: Subject to any disclaimer, the term of this patent is extended or adjusted under 35 U.S.C. 154(b) by 0 days.

(21) Appl. No.: 14/995,210

(22) Filed: Jan. 14, 2016

(65) Prior Publication Data

US 2016/0177620 A1 Jun. 23, 2016

Related U.S. Application Data

(63) Continuation of application No. 14/205,550, filed on Mar. 12, 2014, now abandoned, which is a (Continued)

(51) Int. Cl.

| | |
|---|---|
| ***E06B 5/12*** | (2006.01) |
| ***E05B 17/00*** | (2006.01) |
| ***E05B 63/00*** | (2006.01) |
| ***E05B 65/00*** | (2006.01) |
| ***E05C 3/12*** | (2006.01) |
| ***E05C 19/00*** | (2006.01) |
| ***E05D 11/10*** | (2006.01) |
| ***E05D 15/04*** | (2006.01) |
| ***E06B 3/36*** | (2006.01) |

(Continued)

(52) U.S. Cl.

CPC ..... *E06B 5/12* (2013.01); *E05B 17/0025* (2013.01); *E05B 63/0052* (2013.01); *E05B 65/001* (2013.01); *E05C 3/124* (2013.01); *E05C 17/02* (2013.01); *E05C 19/002* (2013.01); *E05D 11/10* (2013.01); *E05D 15/04* (2013.01); *E06B 1/52* (2013.01); *E06B 3/36* (2013.01); *E06B 7/2301* (2013.01); *Y10T 16/54* (2015.01); *Y10T 16/551* (2015.01); *Y10T 16/558* (2015.01); *Y10T 16/559* (2015.01)

(58) Field of Classification Search

CPC ..... E06B 5/12
USPC ..... 49/383
See application file for complete search history.

(56) References Cited

U.S. PATENT DOCUMENTS

| | | |
|---|---|---|
| 313,742 A | 3/1885 | Kintner |
| 435,658 A | 9/1890 | Brennaman |

(Continued)

FOREIGN PATENT DOCUMENTS

| | | |
|---|---|---|
| AU | 627346 | 2/1991 |
| AU | 641561 | 5/1992 |

(Continued)

*Primary Examiner* — Katherine Mitchell
*Assistant Examiner* — Marcus Menezes
(74) *Attorney, Agent, or Firm* — Mark M. Friedman

(57) ABSTRACT

A closure includes a panel closing against a frame. A set of abutment surfaces for supporting the panel against applied forces is completed by a displaceable abutment block which selectively assumes an engaged state disposed between an abutment surface of the panel and an abutment surface of a strike jamb. The geometry of engagement is such that forces acting on the abutment block opposing opening of the panel are primarily compressive forces. Certain implementations additionally, or alternatively, employ abutment blocks for locking along the lintel or the threshold of the opening.

4 Claims, 24 Drawing Sheets

Related U.S. Application Data continuation of application No. 13/170,196, filed on Jun. 28, 2011, now Pat. No. 8,707,625.

(51) Int. Cl.

| | |
|---|---|
| ***E05C 17/02*** | (2006.01) |
| ***E06B 1/52*** | (2006.01) |
| *E06B 7/23* | (2006.01) |

(56) References Cited

U.S. PATENT DOCUMENTS

| | | | | | |
|---|---|---|---|---|---|
| 1,231,069 | A | * | 6/1917 | Schaffert | E06B 3/12 296/145 |
| 1,973,461 | A | * | 9/1934 | Barringer | E06B 7/232 49/383 |
| 2,572,717 | A | * | 10/1951 | Gersten | E06B 5/006 312/259 |
| 2,579,875 | A | | 12/1951 | Stanko | |
| 2,834,066 | A | | 5/1958 | Lybarger | |
| 3,002,592 | A | | 10/1961 | Quinn | |
| 3,019,493 | A | | 6/1962 | Walenga | |
| 3,159,093 | A | | 12/1964 | Rosenfeld | |
| 3,172,168 | A | | 3/1965 | Suska | |
| 3,634,962 | A | * | 1/1972 | Peterson | E06B 7/24 49/380 |
| 3,841,516 | A | | 10/1974 | Marz | |
| 4,004,629 | A | | 1/1977 | Kelly | |
| 4,045,065 | A | | 8/1977 | Johnson | |
| 4,062,576 | A | | 12/1977 | Jennings et al. | |
| 4,106,239 | A | | 8/1978 | Bancroft et al. | |
| 4,110,867 | A | | 9/1978 | Gwozdz | |
| 4,126,965 | A | * | 11/1978 | Hoffmann | E06B 3/28 49/398 |
| 4,133,142 | A | | 1/1979 | Dzus, Jr. | |
| 4,178,859 | A | * | 12/1979 | Seiz | E05G 1/024 109/27 |
| 4,203,255 | A | | 5/1980 | Naslund et al. | |
| 4,216,986 | A | | 8/1980 | McNinch et al. | |
| 4,300,795 | A | | 11/1981 | Jennings | |
| 4,367,610 | A | | 1/1983 | Goode | |
| 4,441,277 | A | | 4/1984 | Naylor | |
| 4,765,662 | A | | 8/1988 | Suska | |
| 4,831,779 | A | | 5/1989 | Kehrli et al. | |
| 5,137,327 | A | * | 8/1992 | Edmonds | B60J 9/02 16/259 |
| 5,465,460 | A | | 11/1995 | Cantone | |
| 5,660,021 | A | * | 8/1997 | Wolgamot | E06B 5/11 109/76 |
| 6,185,871 | B1 | | 2/2001 | Wang | |
| 6,286,274 | B1 | | 9/2001 | McKann | |
| 6,564,428 | B2 | * | 5/2003 | Richard | E05D 3/127 16/335 |
| 7,000,550 | B1 | * | 2/2006 | Mandall | E06B 9/00 109/1 S |
| 7,578,531 | B1 | | 8/2009 | LeOntaridis | |
| 7,707,776 | B2 | | 5/2010 | Weissofner et al. | |
| 8,038,184 | B2 | | 10/2011 | Grigis | |
| 8,627,606 | B2 | | 1/2014 | Salerno | |
| 8,707,625 | B2 | | 4/2014 | Raz et al. | |
| 8,813,427 | B2 | | 8/2014 | Meeks | |
| 2002/0046501 | A1 | | 4/2002 | Webb | |
| 2002/0095885 | A1 | * | 7/2002 | Sampson | E06B 5/106 52/202 |
| 2002/0163208 | A1 | | 11/2002 | Quigley | |
| 2005/0001436 | A1 | | 1/2005 | Ramsauer | |
| 2007/0290456 | A1 | | 12/2007 | Speyer | |
| 2009/0289065 | A1 | * | 11/2009 | Sampson | E06B 5/12 220/324 |

FOREIGN PATENT DOCUMENTS

| | | | | | |
|---|---|---|---|---|---|
| CA | 1029063 | | | 4/1978 | |
| DE | 929592 | | | 6/1955 | |
| DE | 2628036 | | | 1/1977 | |
| DE | 3447796 | A1 | | 7/1986 | |
| DE | 8900012 | U1 | | 3/1989 | |
| DE | 29517077 | | | 2/1997 | |
| DE | 10117173 | | | 10/2002 | |
| DE | 10322786 | | | 12/2004 | |
| DE | 102004054981 | | | 8/2007 | |
| DE | 10329560 | | | 6/2012 | |
| EP | 0067065 | | | 12/1985 | |
| EP | 1422368 | | | 5/2004 | |
| EP | 1422368 | A1 | | 5/2004 | |
| EP | 1574657 | | | 9/2005 | |
| FR | 2631068 | | | 11/1989 | |
| FR | 2891295 | A1 | | 3/2007 | |
| GB | 1399058 | A | | 6/1975 | |
| GB | 2154639 | B | * | 6/1987 | E05G 1/024 |
| GB | 2195958 | A | * | 4/1988 | B63B 43/32 |
| GB | 2233701 | | | 1/1991 | |
| GB | 2233701 | A | | 1/1991 | |
| GB | 2250772 | A | | 6/1992 | |
| GB | 2521932 | A | | 7/2015 | |
| WO | 2013001488 | A1 | | 1/2013 | |

* cited by examiner 14a
44
42
10
40
14
38
10b
20
36
46
14b

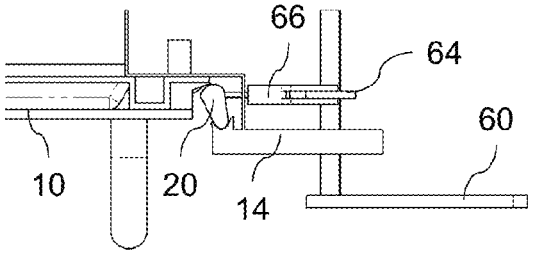
FIG. 12A
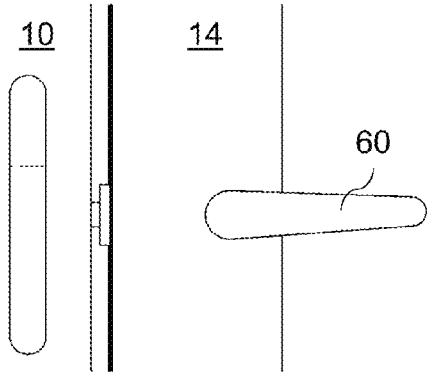
FIG. 12B
FIG. 12C
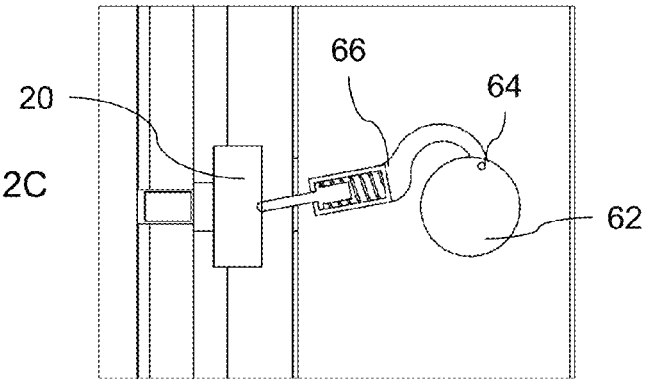

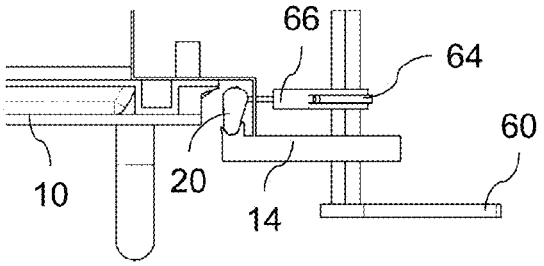
FIG. 14A
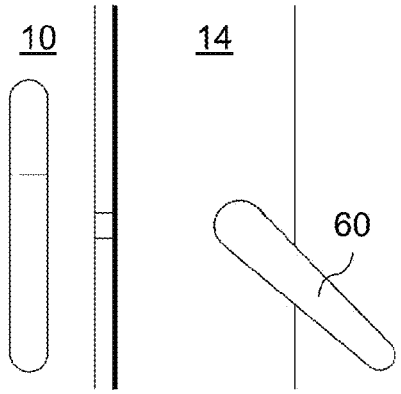
FIG. 14B
FIG. 14C
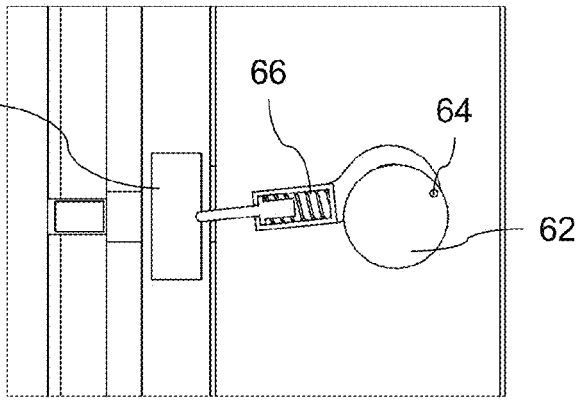

A-A

B-B

ARRANGEMENT FOR SECURING A PANEL CLOSURE

FIELD AND BACKGROUND OF THE INVENTION

The present invention relates to closures and, in particular, it concerns a closure in which a hinged panel is secured against forces.

Hinged panels are widely used as closures for doors, windows and other openings. The term "panel" is used herein generically for any and all such closures. The panel generally closes against a frame. The portion of the frame lying on the side supporting the hinge is referred to as the "hinge jamb". The portion of the frame lying on the side opposite to the hinge jamb is referred to as the "strike jamb".

There is a need for an arrangement for securing a panel closure in a manner effective to withstand forces applied on the panel.

SUMMARY OF THE INVENTION

The present invention is a closure.

According to the teachings of an embodiment of the present invention there is provided, an apparatus comprising: (a) an opening bounded by a frame including a hinge jamb, the frame defining a plane of closure; (b) a panel; (c) a hinge arrangement associated with the panel and the hinge jamb and configured to hang the panel relative to the opening so as to be swingable between an open position removed from the opening and a closed position in which the panel is aligned parallel to the plane of closure within the opening; and (d) an engagement configuration comprising: (i) a projection located in fixed relation to the hinge jamb, and (ii) an engagement feature rigidly associated with the panel, the engagement configuration being configured such that the panel swings freely between the open position and the closed position, and such that, when the panel assumes the closed position, the engagement feature is brought into engagement with the projection such that force directed to displace the panel within the plane of closure away from the hinge jamb is opposed by engagement of the engagement feature with the projection.

According to a further feature of an embodiment of the present invention, the hinge arrangement defines an effective axis about which the panel swings, and wherein the projection is deployed in a recess of the hinge jamb, and wherein the engagement feature is associated with a hinge-side extension of the panel located inwardly towards the recess from the effective axis of the hinge arrangement.

According to a further feature of an embodiment of the present invention, the projection comprises a step extending parallel to an axis of the hinge arrangement, and wherein the engagement feature comprises a projecting lip deployed to engage against the step to oppose forces directed to displace the panel within the plane of closure away from the hinge jamb.

According to a further feature of an embodiment of the present invention, the projecting lip is formed as an edge of a shaped layer of sheet metal making up at least part of the panel.

According to a further feature of an embodiment of the present invention, the projection comprises a plurality of spaced-apart pins projecting from the hinge jamb, and wherein the engagement feature comprises a plurality of complementary apertures formed in the panel, each of the apertures positioned for engaging with one of the pins when the panel assumes the closed position so as to oppose forces directed to displace the panel within the plane of closure away from the hinge jamb.

BRIEF DESCRIPTION OF THE DRAWINGS

The invention is herein described, by way of example only, with reference to the accompanying drawings, wherein:

FIGS. 12A, 12B and 12C are a horizontal cross-sectional view, a front view and a vertical cross-sectional view, respectively, of a manual actuation mechanism for actuating the closure of FIG. 9A, the actuation mechanism being shown in an on-the-latch state;

FIGS. 14A, 14B and 14C are views similar to FIG. 12A, FIGS. 12B and 12C, respectively, the actuation mechanism being shown in a released state for allowing opening of the panel;

DESCRIPTION OF THE PREFERRED EMBODIMENTS

Figure 1A:
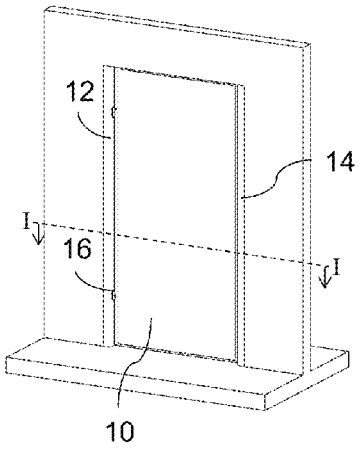
FIGS. 1A, 1B and 1C are schematic illustrations of a closure, constructed and operative according to an embodiment of the present invention, in which a panel is shown in a closed position, a first open position and a second open position, respectively.

The present invention is a closure in which a hinged panel is secured against bidirectional forces.

The principles and operation of closure according to the present invention may be better understood with reference to the drawings and the accompanying description.

By way of introduction, the following description and the accompanying drawings refer to a number of exemplary and non-limiting embodiments of the present invention which share common underlying principles, and which also share many structural features. For simplicity of presentation, a general description of multiple embodiments will now be presented with reference primarily to FIGS. 1A, 1B and 1C and FIGS. 2A, 2B and 2C. It should be noted, however, that the same description applies equally to multiple additional embodiments described below, mutatis mutandis, even where different reference numerals have been used. Wherever a horizontal cross-sectional view is illustrated herein below, unless stated otherwise, it corresponds to a view taken along line I-I of FIG. 1, but showing features of the corresponding specific embodiment, and various states of opening of the panel, all as will be clear from the context of the drawing as discussed below.

Figure 1B:
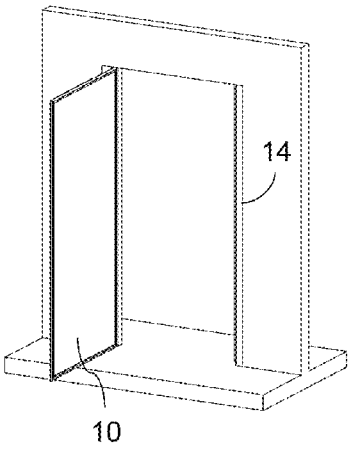
Figure 1C:
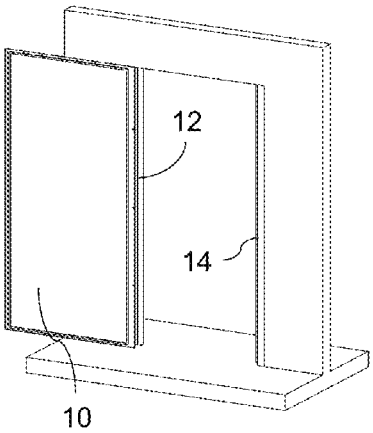

FIGS. 1A, 1B and 1C show an overview of the present invention, which provides a closure in which a hinged panel 10 closes against a frame which includes at least a hinge jamb 12 and a strike jamb 14. Panel 10, mounted via one or more hinges 16 to hinge jamb 12, assumes a closed position (FIGS. 1A and 2A) in which panel 10 abuts a primary abutment surface 12*a* of the hinge jamb 12 and a primary abutment surface 14*a* of the strike jamb 14, providing an at least partial closure for an opening defined by the frame. Panel 10 is hingedly movable towards a "swing-side" 18 of the opening to an open position (FIGS. 1B, 1C and 2C) in which the opening is substantially unobscured. The primary abutment surfaces 12*a* and 14*a* of the hinge jamb and the strike jamb are deployed to provide bilateral support to oppose forces $F_1$ (FIG. 2A) acting on panel 10 and tending to displace the panel away from swing-side 18 of the opening, i.e., beyond the normal fully closed position of the panel.

According to certain preferred embodiments of the invention, panel 10 includes a hinge-side extension 10*a* deployed relative to hinge 16 so as to close against a secondary abutment surface 12*b* of hinge jamb 12, located in a recess 12*c* of the hinge jamb, as the panel is brought into the closed state.

Figure 2A:
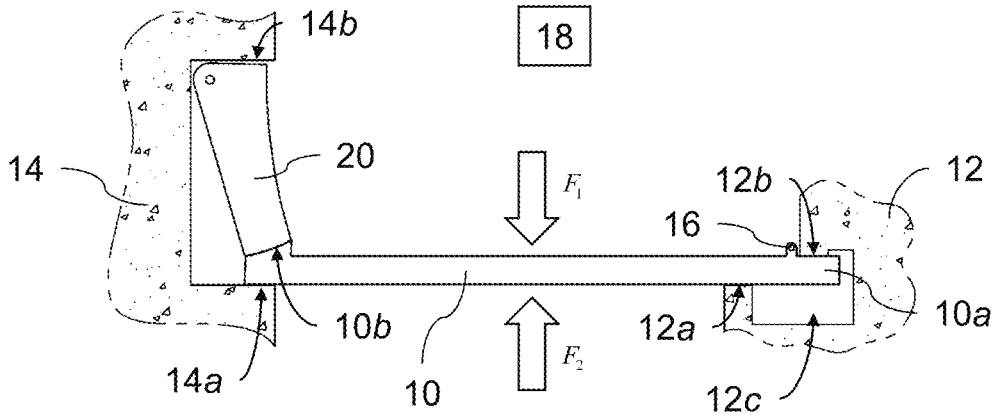
FIGS. 2A, 2B and 2C are schematic horizontal cross-sectional views (not to scale) taken through an embodiment of the present invention, in which a panel is shown in a closed, intermediate and open position, respectively.
Figure 2B:
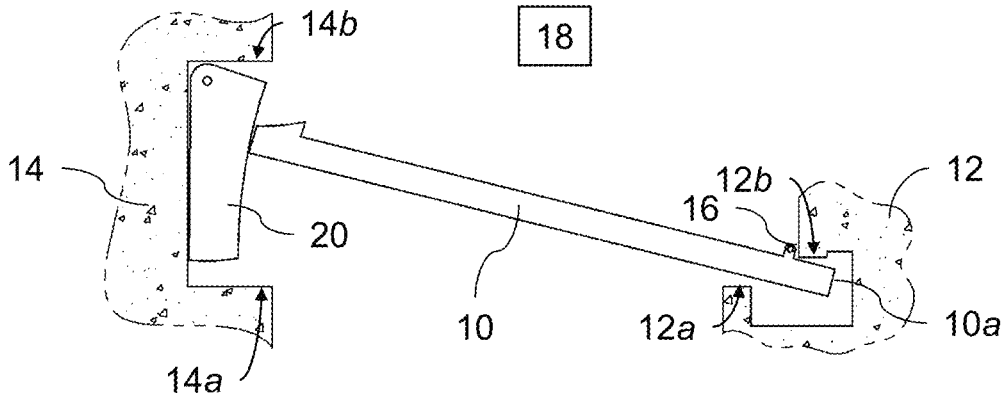
Figure 2C:
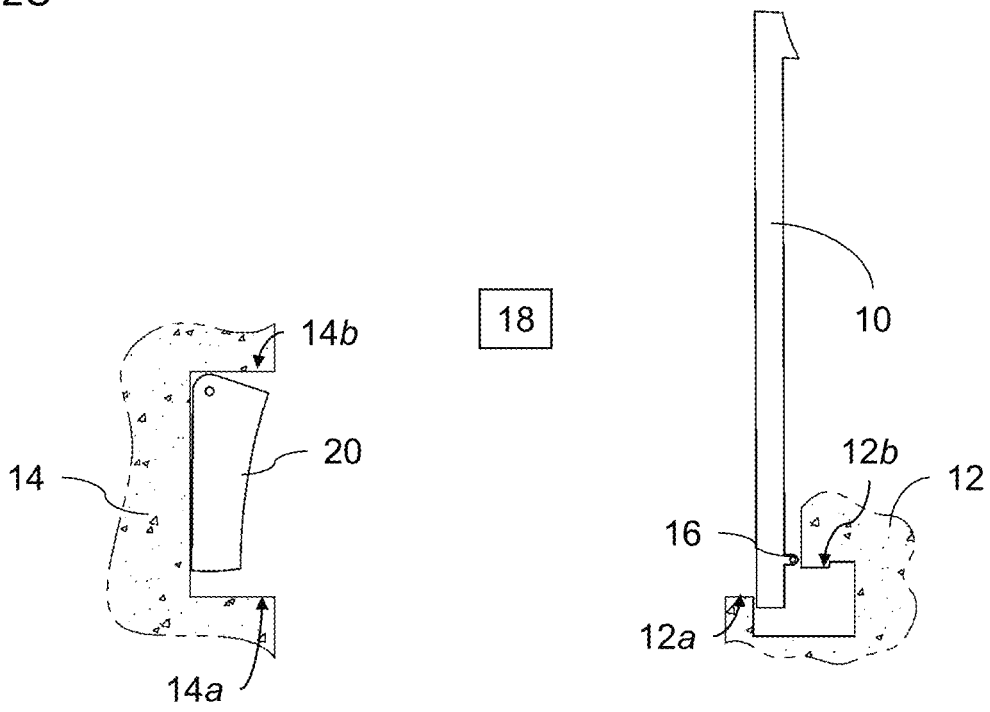

When panel 10 is in its closed position, it is secured against opening by an abutment block 20 in an engaged state (FIG. 2A) in which abutment block 20 is disposed between an abutment surface 10*h* of panel 10 and a secondary abutment surface 14*b* of the strike jamb 14. To open panel 10, abutment block 20 is displaceable to a disengaged state in which the abutment block is displaced so as to allow hinged motion of the panel towards the open position (FIGS. 2B and 2C). Secondary abutment surfaces 12*b* and 14*b* of the hinge jamb 12 and the strike jamb 14 are deployed to oppose forces $F_2$ tending to displace the panel towards the swing-side of the opening, i.e., towards the side to which the panel opens.

It is a particularly preferred feature of certain preferred embodiments of the present invention that panel abutment surface 10*b*, abutment block 20 and the secondary abutment surface 14*b* of strike jamb 14 are configured such that, when abutment block 20 assumes the engaged state, forces acting on abutment block 20 opposing opening of panel 10 are primarily compressive forces, and most preferably, do not generate a bending moment on the abutment block.

At this stage, various advantages of the present invention will already be apparent. Specifically, in the closed state of the panel with the abutment block engaged, panel 10 is provided with bilateral support against forces in both an inward and an outward direction. The reliance on compressive forces facilitates implementations which withstand greater forces than would be accommodated by conventional bolts and other elements which rely on resistance to bending. At the same time, the structure is particularly simple, and can be implemented as a normally-locked mechanism which is resistant to applied force whenever closed, without requiring an additional locking operation. These and other advantages of various embodiments of the present invention will be better understood by reference to the following drawings and the accompanying description.

Before addressing the features of certain embodiments of the present invention in more detail, it will be useful to define certain terminology as used herein in the description and claims. Firstly, the term "closure" is used herein to refer generically to any arrangement for selectively closing an opening in a structure, typically a building or vehicle. The term "panel" is used to refer to the element deployed across at least part of the opening in the closed state. The panels and corresponding closures may be doors, windows or any other type of opening which is selectively closed (or partially closed) by a hinged panel.

The term "jamb" is used to refer to any structural support at the sides of opening providing abutment surfaces against which the panel closes, and includes the possibility of multiple separate components providing separate abutment surfaces. The "hinge jamb" is the jamb on the side of the opening where the panel is mounted on a hinge, although the hinge is not necessarily mounted directly to the jamb. The term "strike jamb" is used generically for the jamb on the side of the opening furthest from the hinge, and should not be taken to imply the presence of any "strike plate" structure. The two jambs are typically part of a frame surrounding the opening on at least three sides, and optionally on four sides. The term "lintel" is used to refer to a top edge of the frame and the word "threshold" is used to refer to the lower edge of the frame. Although more often used in the context of doors, this terminology is used herein in the description and claims to refer to the corresponding components of frames of any and all openings to which the present invention may be applied, including windows and other openings. The jambs (and entire frame) may be a distinct dedicated structure installed within a larger original opening in a wall, or may be formed as an integral part of a wall, floor or ceiling, with or without additional elements to define the abutment surfaces.

In various embodiments, the abutment block is described as "displaceable" or "retractable". These terms refer to the ability of the abutment block to move between the engaged and the disengaged positions, but does not imply any particular type of motion. In many of the embodiments described herein, the displacement or retraction is achieved by a pivotal motion of the abutment block.

For the purpose of defining directions of forces and other geometrical definitions, reference is made to a plane of the opening, defined by the plane in which the panel lies in its normal fully closed position. Where the panel has significant thickness or is significantly non-planar in its shape, this plane may be arbitrarily defined as a central plane lying within the overall thickness of the panel as defined by any suitable best-fit algorithm. This plane of the opening may be considered to subdivide the Universe into two parts, with the part lying on the side of the plane towards which the panel moves during normal hinged opening being referred to as the "swing side" of the door, and the opposing part being referred to as "away from the swing side" or "beyond the closed position", or simply the "non-swing side". It should be noted that, due to the bidirectional resistance of the structures of the present invention to applied forces, there is typically no requirement as to whether the "swing side" is facing inwards or outwards relative to the protected structure.

Figure 18:
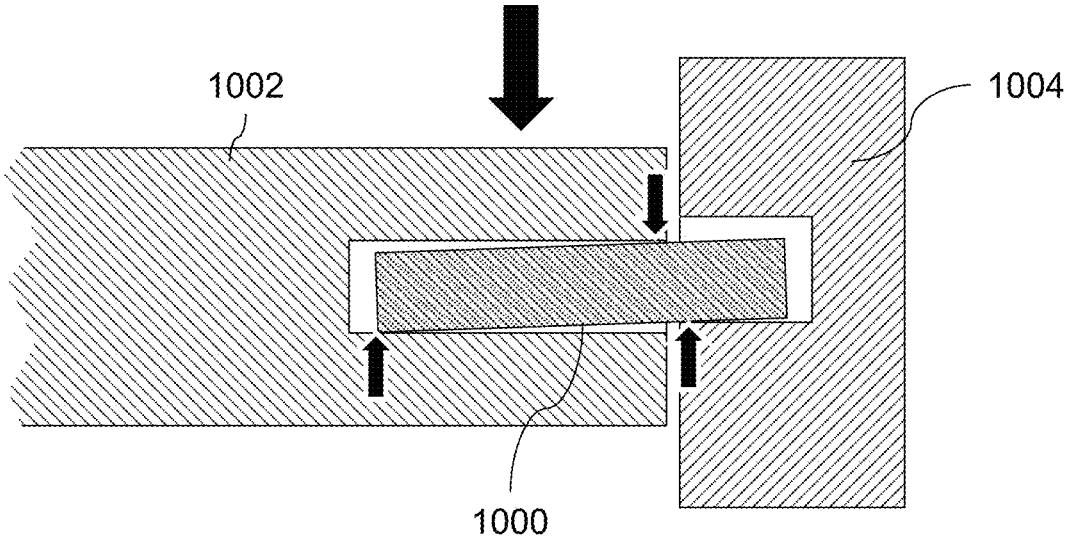
FIG. 18 (PRIOR ART)
FIG. 18 is a schematic illustration of the forces acting on a conventional bolt employed to lock a panel within a frame.

The forces on the abutment block in the engaged state are described as being "primarily compressive". This phrase is used to distinguish between the type of forces acting on a conventional bolt and those acting on the abutment block of the present invention. Specifically, referring briefly to FIG. 18, this shows schematically the forces acting on a bolt 1000 extending between a door 1002 and a jamb 1004 to resist forces acting to open the door. The efficacy of bolt 1000 to resist opening of door 1002 is fundamentally dependent upon the resistance of the bolt to bending, which is inherently weaker than the resistance of the same material under direct compression. The bending moment exerted on the bolt is also highly sensitive to the clearance between the door panel and the jamb, which cannot be overly reduced due to the clearance required to allow the door to open. In many cases, the centers of the effective abutment surfaces under high load conditions are significantly inwardly located from the edges of the door panel and the jamb, resulting in greatly increased bending moments on the bolt, and correspondingly less ability to withstand an impact or blast. Finally, reliance on a bolt typically requires reinforcing of the structure of a door panel on both sides (internal and external) of the bolt, leading to relatively thick and heavy door structures. For all these and other reasons, the use of abutment elements that experience primarily compressive forces according to the present invention is considered highly advantageous.

In certain particularly preferred implementations, the abutment geometry is such that forces opposing opening of the panel do not generate a bending moment on the abutment block. In this context, it should be noted that the lack of bending moment relates to the primary load-bearing forces which dominate under high load conditions, and does not take into consideration forces resulting from spring bias element, a pivot hinge on which the abutment block may be mounted, or any other components which interact with the abutment block but which are not designed to be primary load-bearing components under conditions of loading approaching the design limitations of the closure.

The word "locked" is used herein in the description and claims to refer to a state in which mechanical engagement prevents opening of the panel, and provides effective support to oppose forces acting to try to open the panel. In contrast to a conventional latch mechanism which typically requires a secondary bolt to provide more significant support, preferred structures according to the present invention are inherently braced against applied impacts or blasts whenever locked, and are most preferably inherently locked whenever they are closed.

As a corollary to the above, the word "lock" in this document does not imply any particular mechanism for limiting unauthorized access through the opening, such as a cylinder lock or an electronic lock. Such devices may indeed be used together with the present invention, for example as a part of an actuation mechanism as will be described below with reference to FIGS. 12A, 12B, 12C, 13A, 13B, 13C, 14A, 14B and 14C, as will be clear to a person having ordinary skill in the art. However, such devices do not constitute part of the present invention, and will therefore not be described herein.

Certain configurations of the locking arrangements of the present invention are described as providing "frictional locking". Specifically, in certain preferred cases, the deployment and surface properties of abutment block 20, abutment surface 10*b* of the panel and secondary abutment surface 14*b* of the strike jamb are such that, when the panel is in its closed position and abutment block 20 is engaged, forces tending to displace panel 10 towards swing-side 18 generate frictional locking of abutment block 20 between panel 10 and strike jamb 14. The conditions for frictional locking, derived simply from the coefficient of friction between the surfaces, are well known. This frictional locking helps to ensure that forces acting on the abutment block remain primarily compressive, and is particularly valuable for embodiments such as will be illustrated below with reference to FIG. 5A. Additionally, or alternatively, the geometrical forms of the abutment surfaces may be chosen to provide geometrical locking, such as will be seen in FIG. 11A described below.

In certain cases, an embodiment of the invention may be used as a blast resistant closure, typically a door or window, for a shelter. Requirements for such structures are typically defined by various military or governmental bodies. In Israel, current requirements preclude the use of inwardly-opening hinged doors, since currently-available options typically have greatly reduced blast resistance towards the swing side of the opening. In the context of the present invention, as mentioned above, inward-opening deployment can readily be implemented to withstand the required level of blast impulse, and may actually offer significant safety benefits, reducing the complications of rescue operations where debris may prevent outward opening of a door. Thus, particularly preferred implementations of a blast door according to the present invention provide effective bidirectional protection, both against an initial blast and against a "rebound" effect, and can be mounted in either inward-opening or outward-opening configurations.

Certain implementations of the present invention may also be highly advantageous for use as a hurricane protection door. All such applications as blast resistant doors and hurricane protection doors may be referred to generically as "doors for protection from air-pressure forces", whether positive or negative pressure.

Figure 3:
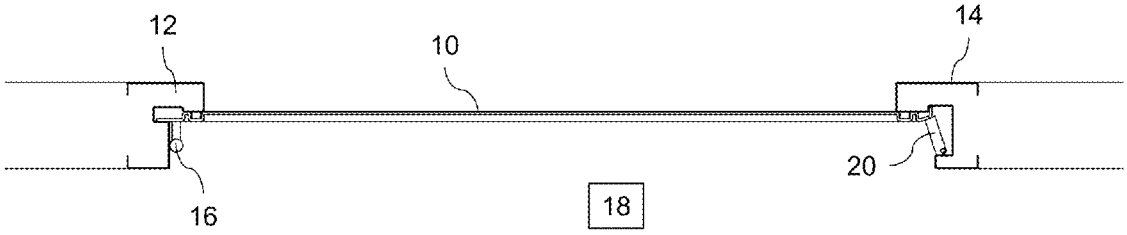
FIG. 3 is a schematic horizontal cross-sectional views taken through an embodiment of the present invention, in which a panel is shown in a closed position.
Figure 4:
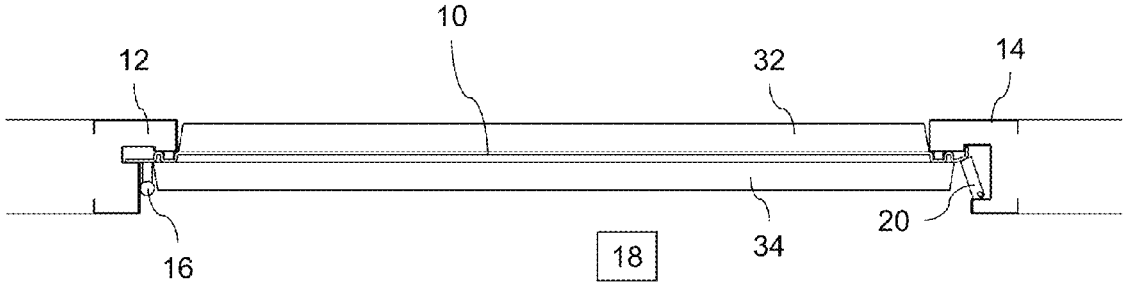
FIG. 4 is a view similar to FIG. 3, showing a variant embodiment having facing panels on both faces of the main panel.

Turning now to the features of certain preferred embodiments of the present invention in more detail, FIGS. 3, 4, 5A, 5B, 5C, 5D, 5E, 5F, 6A, 6B, 6C, 6D and 6E illustrate a closure, in this case a door, constructed and operative according to an embodiment of the present invention. FIG. 3 is a full horizontal cross-section taken through the structure, while FIG. 4 is an implementation of the same structure with addition of facing panels 32 and 34 on both faces of panel 10. In general terms, this embodiment is structurally and functionally similar to that of FIGS. 2A, 2B and 2C, and equivalent elements are labeled similarly.

Figures 5A, 5B, 5C, 5D, 5E, 5F:
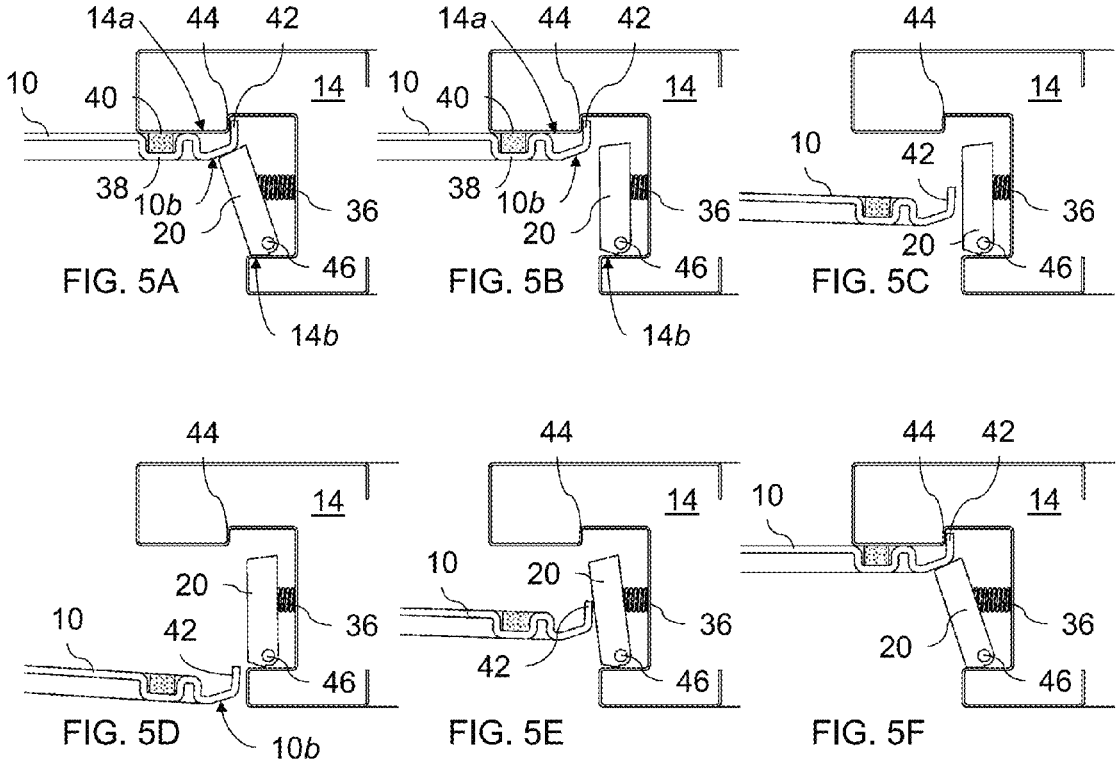
FIGS. 5A, 5B, 5C, 5D, 5E and 5F are enlarged partial views of the embodiment of FIG. 3 showing interactions of an abutment block with an edge of the panel and a strike jamb during opening and closing of the panel.

FIGS. 5A, 5B, 5C, 5D, 5E and 5F show in more detail the interaction of panel 10 with strike jamb 14 and abutment block 20. FIG. 5A shows the closed state in which panel 10 is closed against primary abutment surface 14*a*, and abutment block 20 is biased by a spring 36 to its engaged state. In the case illustrated here, panel 10 is a door formed primarily from press-formed sheet metal. A peripheral channel 38 receives a sealing strip 40, typically of rubber, which provides the surface for closing on primary abutment surface 14*a*. In the example shown here, the outer flange of panel 10 is formed with an oblique angled portion which serves as panel abutment surface 10*b* against which abutment block 20 engages. Additionally, the edge of the panel flange is further bent over to form a projecting lip 42 extending around the outside of a step 44 formed in strike jamb 14. The engagement of projecting lip 42 around step 44 provides anchoring against inward deformation of the door that may occur if the door bows in the middle under extreme stress.

In applications in which a gas-proof seal is required without particularly high strength, the combination of interlocking with the frame together with sealing strip 40 allows the use of a much thinner panel than is conventionally used. Most preferably for such applications, configurations for anchoring against inward deformation of the panel (that would otherwise pull it away from the frame) are provided around at least three edges, and most preferably all four edges, of the opening. The seal is reliably maintained even under conditions of significant flexing of the center of the panel, with the panel functioning essentially like a diaphragm seal secured around its periphery.

Even where blast resistance is required, the anchoring of the panel around its periphery allows much greater bowing of the panel to be tolerated without compromising the protective properties of the closure, thus allowing relatively thin sheet metal implementations produced by stamping production processes.

FIGS. 5B, 5C and 5D illustrate the sequence of opening the panel. Abutment block 20 is first displaced to its disengaged state, as shown in FIG. 5B, either manually or by a suitable actuation mechanism. A non-limiting example of a suitable actuation mechanism will be described below with reference to FIGS. 12A, 12B, 12C, 13A, 13B, 13C, 14A, 14B and 14C. Panel 10 is then free to swing towards its open position, as illustrated in FIGS. 5C and 5D.

As mentioned above, abutment block 20 is preferably biased from its disengaged state back towards its engaged state, and is deployed such that, when panel 10 is swung from the open position towards the closed position, abutment block 20 is temporarily displaced towards the disengaged state and then returns to the engaged state to lock the panel in the closed position. This sequence is illustrated in FIGS. 5E and 5F. Abutment block 20 thus operates as a latch, automatically engaging the panel as it reaches its fully closed position, as shown in FIGS. 5E and 5F. As a result, the panel is always in its locked state when closed, without requiring an additional locking action.

In the particularly preferred implementation illustrated here, retraction and reengagement of abutment block 20 is achieved by rotating it around a pivot axis 46 extending substantially parallel to an edge of the opening defined by the strike jamb. For this purpose, abutment block 20 is pivotally mounted to the strike jamb, typically on an elongated pivot rod.

Parenthetically, in this and other embodiments of the present invention, it should be noted that the invention may be implemented with a number of abutment blocks implemented as separate elements spaced along the height of the jamb. More preferably, a single abutment block extends along at least 20 percent of the height of the panel, more preferably along a majority of the height of the panel, and in most preferred cases, along more than 90 percent of the height of the panel, thereby allowing simple unitary actuation of the abutment block while providing support to the panel along most of its height.

Figure 6A:
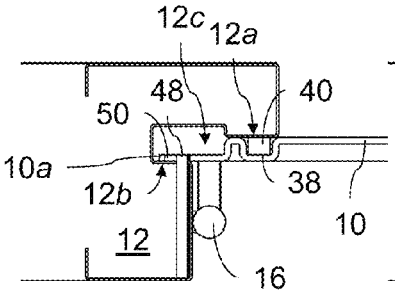
FIGS. 6A, 6B, 6C, 6D, 6E are enlarged partial view of the embodiment of FIG. 3 showing the position of the panel relative to a hinge jamb during opening of the panel.
Figure 6B:
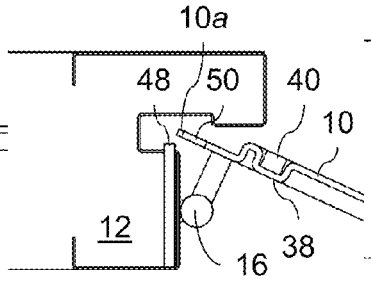
Figure 6C:
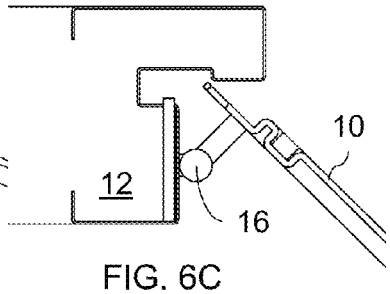
Figure 6D:
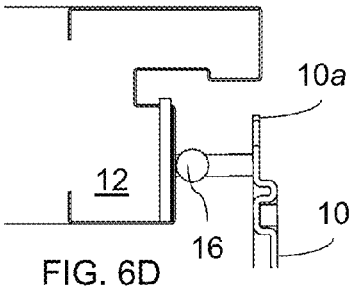
Figure 6E:
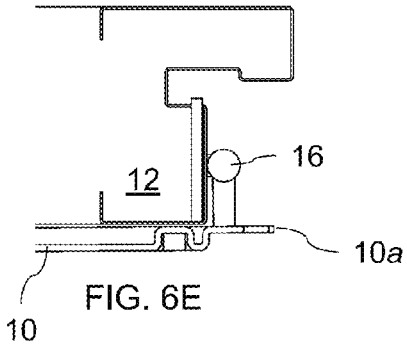

FIGS. 6A, 6B, 6C, 6D and 6E illustrate in further detail the hinge-side of the closure during opening of the panel. Here too, the peripheral channel 38 with sealing strip 40 may be seen, initially closing against primary abutment surface 12*a* as seen in FIG. 6A. Also seen here is a preferred implementation of hinge 16 which allows panel 10 to swing through at least 90 degrees (FIG. 6D), and most preferably to in excess of 160 degrees (typically a full 180 degrees), as shown in FIG. 6E. If desired, similar geometry may be used to implement even more extreme opening of the panel, up to for example 270 degrees.

According to a further preferred option illustrated here, secondary abutment surface 12*b* is provided with a number of vertically spaced projecting pins 48 and the hinge-side extension 10*a* of the panel is formed with complementary apertures 50 which engage pins 48 as the panel reaches its fully closed position. This engagement serves the same purpose as projecting lip 42 on the strike jamb side of the panel, locking the edge of the panel against being drawn inwards under forces which would otherwise cause bowing of the panel and tend to extract the panel from the jambs.

The illustrations referred to thus far all show the engagement of panel 10 with the vertical jambs at the sides of the opening. The frame around the opening typically also includes a lintel interconnecting between the hinge jamb and the strike jamb. In certain cases, a conventional lintel with a single abutment surface may be used. In such cases, the bilateral support provided by the engagement of the panel with both the hinge jamb and the strike jamb is generally sufficient to provide effective locking and resistance to forces acting on the panel.

Figure 7:
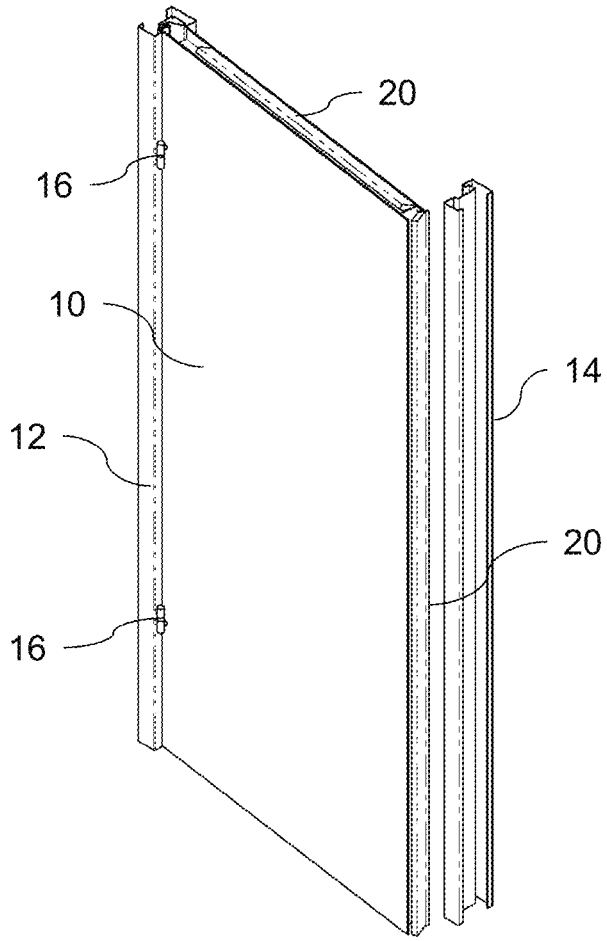
FIG. 7 shows schematically part of a closure according to a further embodiment of the present invention in which one or more abutment block is retractably mounted on the panel.
Figure 16A:
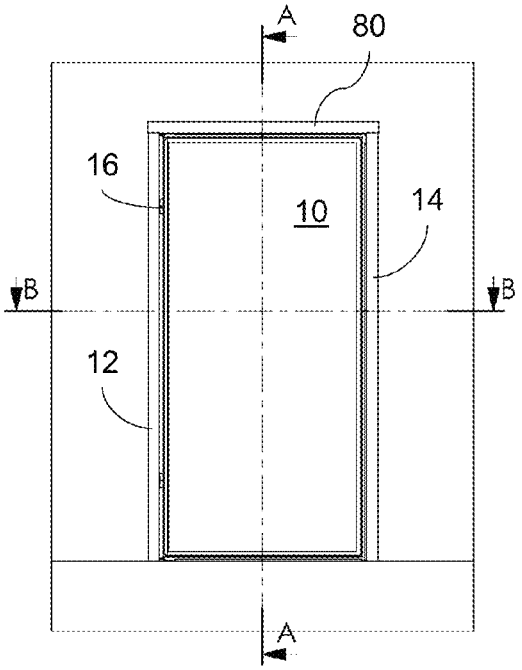
FIG. 16A is a front view of a closure according to an embodiment of the present invention including abutment blocks at the top and bottom edges of the closure.
Figure 16B:
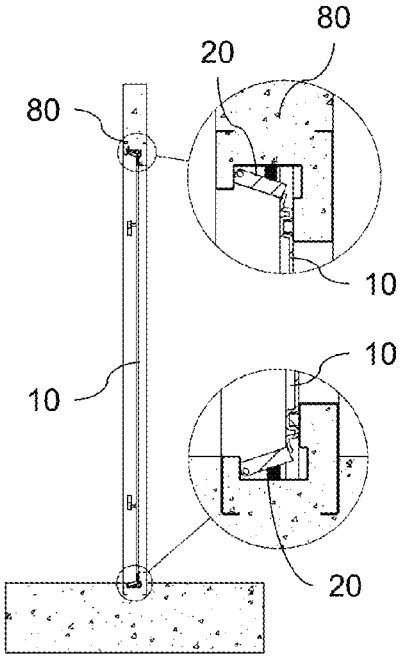
FIG. 16B is a vertical cross-sectional view taken along the line A-A of FIG. 16A.
Figure 16C:
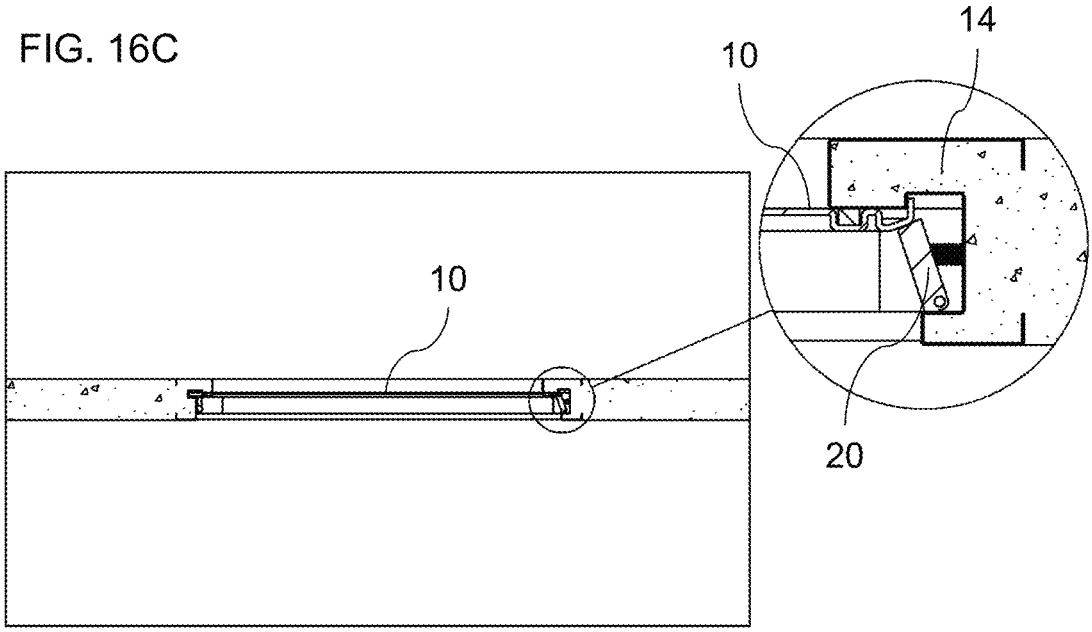
FIG. 16C is a horizontal cross-sectional view taken along the line B-B of FIG. 16A.

In a further optional implementation illustrated in FIGS. 16A, 16B and 16C, the lintel 80 may additionally, or alternatively, be provided with a supplementary abutment block 20 pivotally mounted to the lintel so as to assume an engaged state for engaging an abutment surface along a top edge of panel 10 and a disengaged state (not shown) for allowing swinging of the panel from the closed position towards the open position, in a manner fully analogous to the structure and function of the strike jamb engagement described above. In the particularly preferred non-limiting example illustrated here, a similar locking arrangement is also deployed along the lower edge (threshold) of the opening. Both the upper and lower locking arrangements are best seen in the enlarged insets of FIG. 16B. In the case of a door, the spring biasing of the abutment block along this lower edge may advantageously be neutralized by any suitable latch arrangement (not shown) while the door is open in order to minimize any tripping obstacle. In the exemplary embodiment illustrated here, the horizontal cross-sectional view of FIG. 16C is generally similar to that of FIG. 4, described above, although a reverse implementation with the abutment blocks retractable into the panel itself as shown in FIG. 7 below may also be used. The structure and function of all aspects of this embodiment will be fully understood by analogy to the various embodiments described herein above. For high security applications, such as safes, it may be considered preferably to employ locking configurations along the side, top and bottom of the panel. In certain applications, such as for double doors, locking may be exclusively performed along the top and/or bottom edges of the panel(s).

Turning now to FIGS. 7, 8A, 8B and 8C, these illustrate schematically another subset of implementation of the present invention in which abutment block 20 is retractably mounted relative to panel 10. In a preferred implementation of this approach, abutment block 20 is pivotally mounted to panel 10 so as to be pivotable around a pivot axis extending substantially parallel to an edge of the panel.

The structural and operational principles of this arrangement remain the same as those described above with the jamb-mounted block, differing only in relation to the retraction motion of abutment block 20 and to which component is it mounted.

In the example of FIG. 7, there is also shown a supplementary abutment block pivotally mounted along a top edge of the panel as to assume an engaged state for engaging an abutment surface of the lintel and a disengaged state for allowing swinging of the panel from the closed position towards the open position.

Figure 8A:
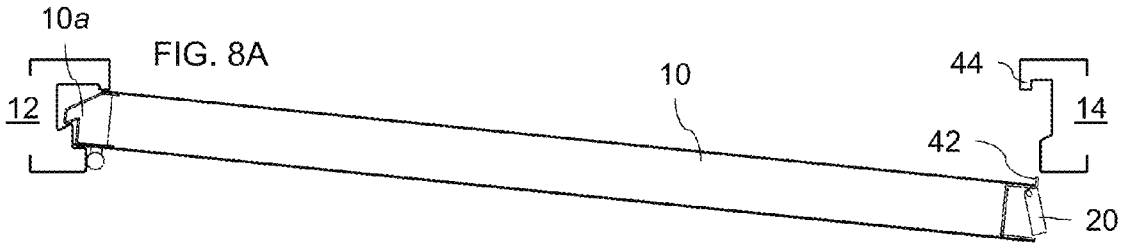
FIGS. 8A, 8B and 8C are horizontal cross-sectional views taken through the embodiment of FIG. 7 showing the successive positions during closing of the closure.
Figure 8B:
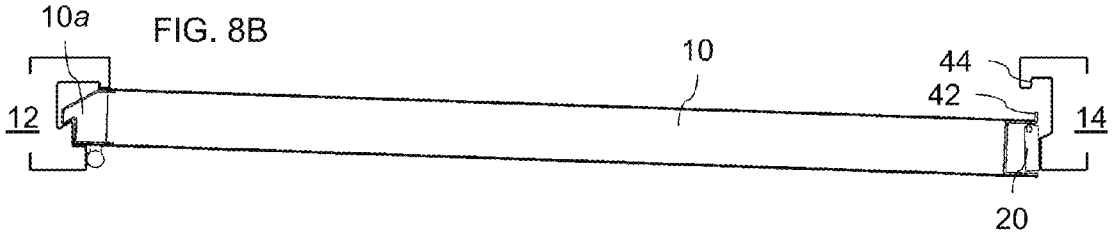
Figure 8C:
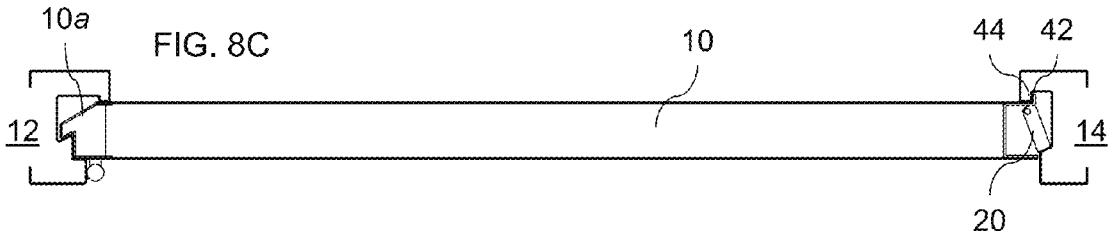

Also visible in FIGS. 8A, 8B and 8C is an alternative geometrical form of inter-engagement between the hinge-side extension 10*a* of panel 10 and hinge jamb 12. In this case, hinge-side extension 10*a* includes an acute-angled recess which engages an acute-angled projection within the hollow recess of the hinge jamb, thereby defining an undercut engagement deployed to resist inward displacement of the door panel. It will be noted that the hinge-side interlocking geometry is generally interchangeable between the different embodiments of the present invention.

The strike-jamb side of panel 10 is shown here formed with projecting lip 42 for engaging complementary step 44 of strike jamb 14, in a manner similar to that described above.

Turning now to FIGS. 9A, 9B, 9C, 10A, 10B, 10C, 10D, 11A, 11B, 11C, 11D, 11E, 11F, 11G, 11H, 12A, 12B, 12C, 13A, 13B, 13C, 14A, 14B and 14C, there is illustrated a closure constructed and operative according to an embodiment of the present invention. This embodiment is generally similar to that of FIG. 3 other than with regard to certain features that will now be detailed.

Figure 9A:
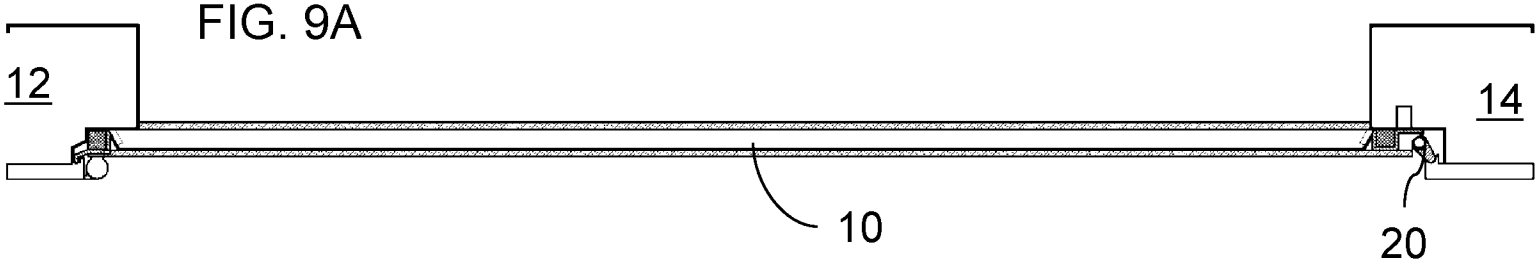
FIG. 9A is a horizontal cross-sectional view of a closure according to an embodiment of the present invention including an arrangement for tightening closure of the panel.
Figure 9B:
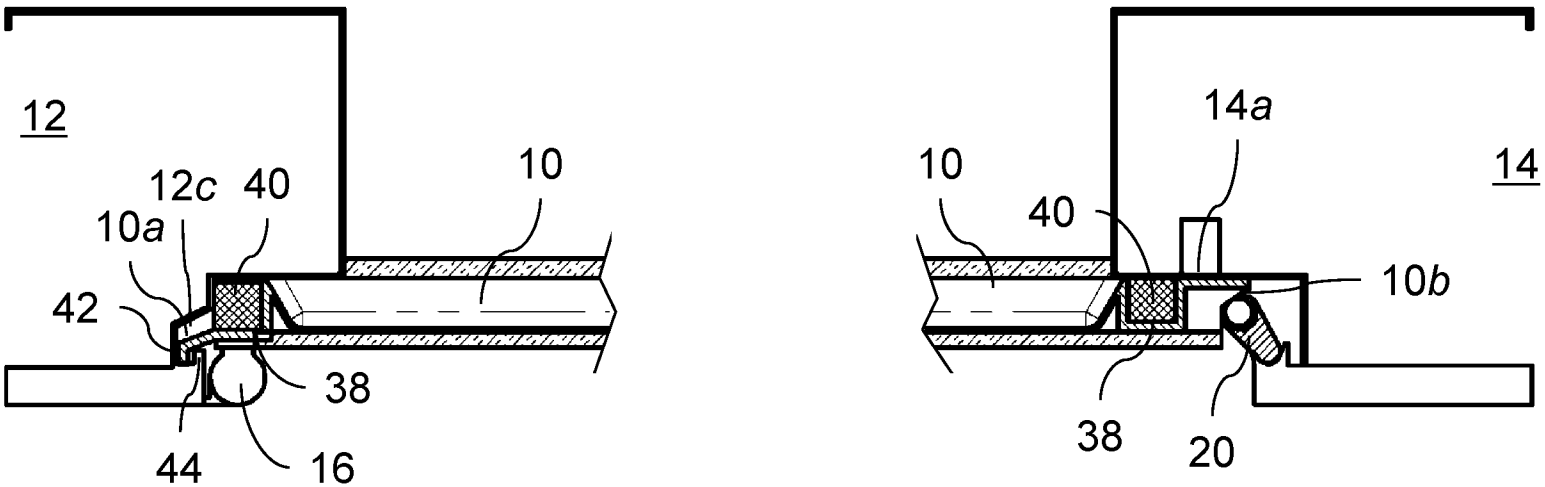
FIG. 9B is an enlarged view of parts of FIG. 9A.
Figure 10B:
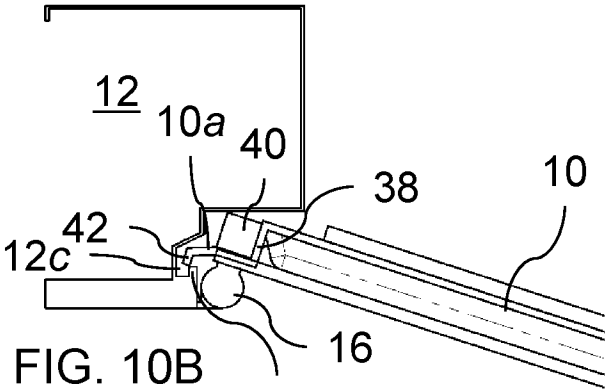
FIGS. 10A, 10B, 10C and 10D are enlarged partial views of the embodiment of FIG. 9A showing the position of the panel relative to a hinge jamb during opening of the panel.
Figure 10D:
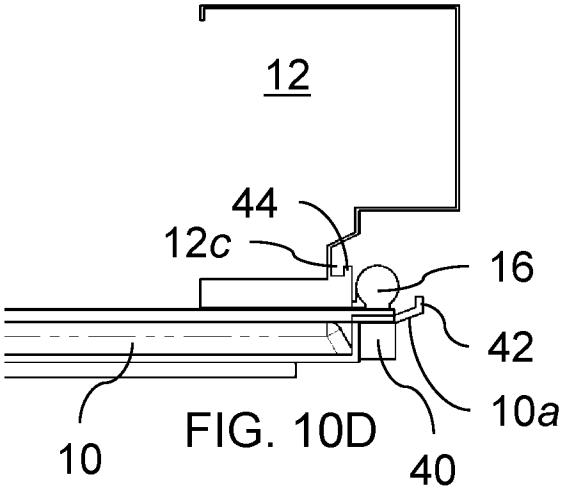
Figure 10A:
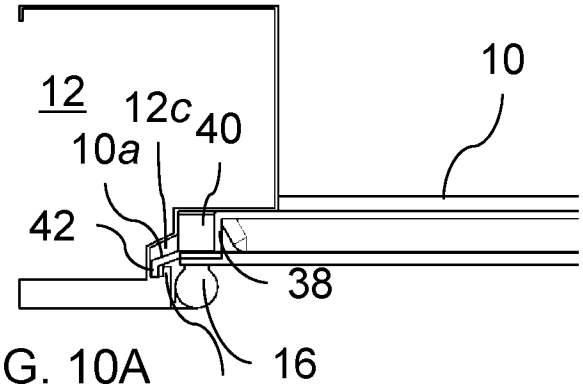
Figure 10C:
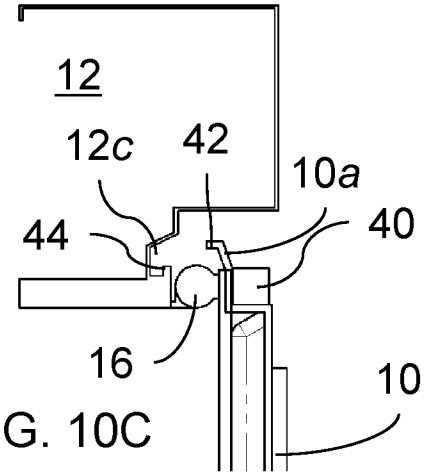

Primarily, the embodiment of FIG. 9A illustrates a further optional feature according to which displacement of abutment block 20 from the disengaged state beyond the engaged state effects tightening of panel 10 against primary abutment surface 14*a* of the strike jamb. This additional tightening capability is particularly valuable where a tight sealing action is required, such as for gas-proof shelter doors.

Figure 11B:
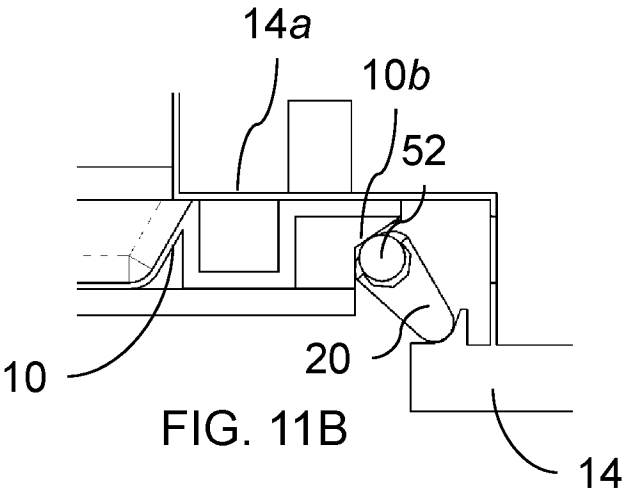
FIGS. 11A and 11B are enlarged partial views of the embodiment of FIG. 9A at two stages during tightening of an edge of the panel against the strike jamb.
Figure 11A:
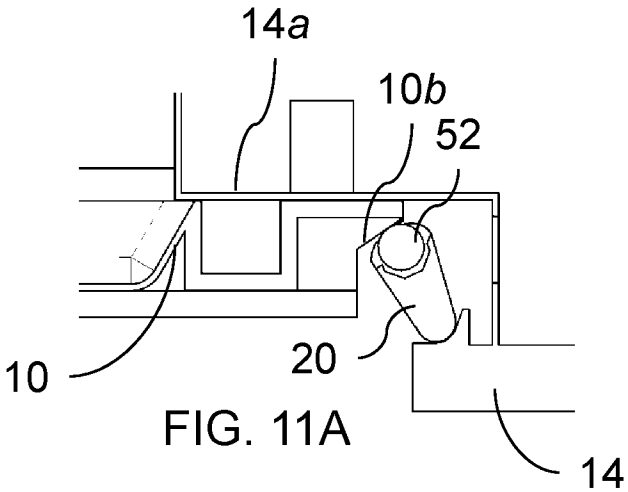

One particularly preferred but non-limiting implementation of this tightening mechanism is shown in FIGS. 11A and 11B. In order to reduce wear on the abutment block during tightening and/or to provide other advantages described below, FIG. 11A shows an implementation of abutment block 20 with a number of roller bearings 52, which may be implemented either as balls or rollers. The roller bearings 52 preferably project slightly from the surface of the abutment block. In the position of FIG. 11A, the bearings are already lodged on the obliquely angled abutment surface 10*b* to provide engagement which prevents opening of the panel. However, the geometry is such that further forced motion of the abutment block to the position of FIG. 11B achieves further tightening of panel 10 against strike jamb 14.

Figure 11D:
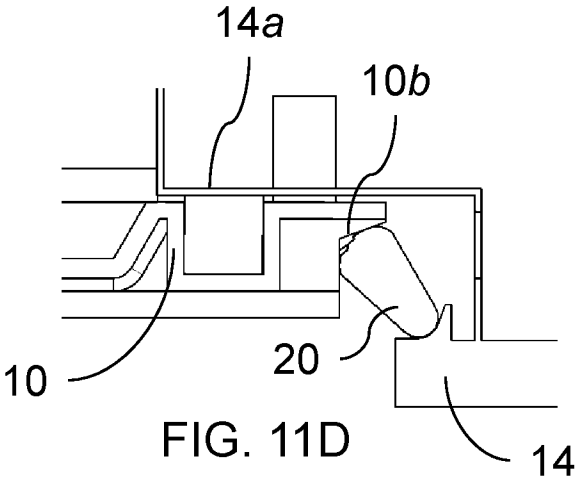
FIGS. 11C, 11D and HE are views similar to FIG. 11B taken at different heights and illustrating the abutment surfaces operating in the event of a blast acting on the panel.
Figure 11C:
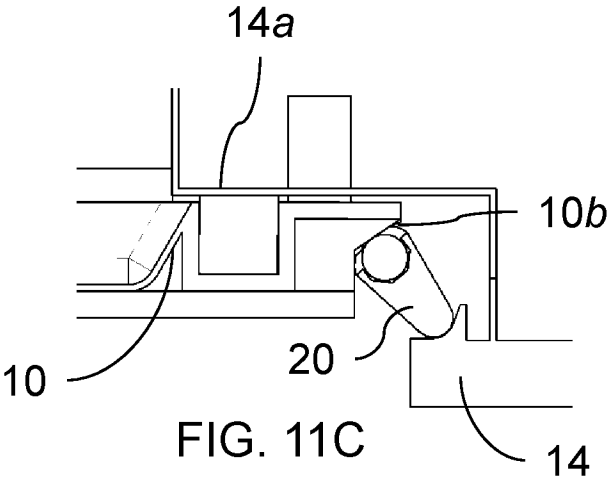
Figure 11E:
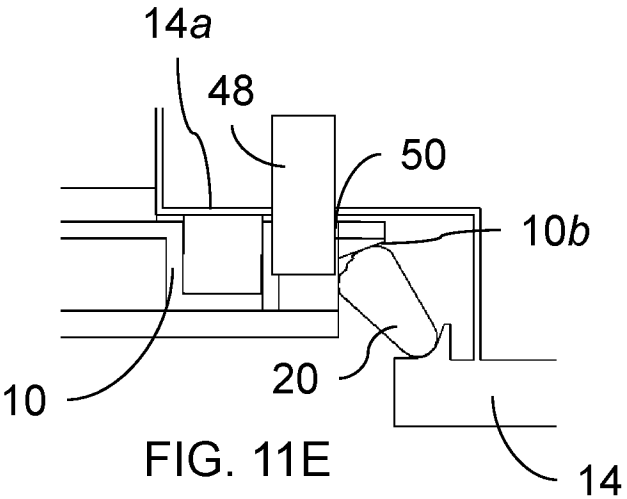
FIG. 11F is a partial isometric view of the closure of FIG. 9A cut away on the plane of sectioning of FIG. 11E.
FIGS. 11G and 11H are views taken similar to FIGS. 11C and 11D illustrating the effect of a blast acting on the panel while the abutment element is in the position of FIG. 11A.

FIGS. 11C, 11D and 11E illustrate the effect of a blast acting on the panel towards the swing-side of the opening while abutment block 20 is in the position of FIG. 11B. In this case, roller bearings 52 are preferably configured to either resiliently retract or to collapse (FIG. 11C), so that the primary load is transferred to the solid abutment surfaces of abutment block 20. FIG. 11D shows a cross-section similar to FIG. 11C taken at a different height so as not to intersect with the roller bearings, instead illustrating the solid abutment surface of abutment block 20.

Figure 11G:
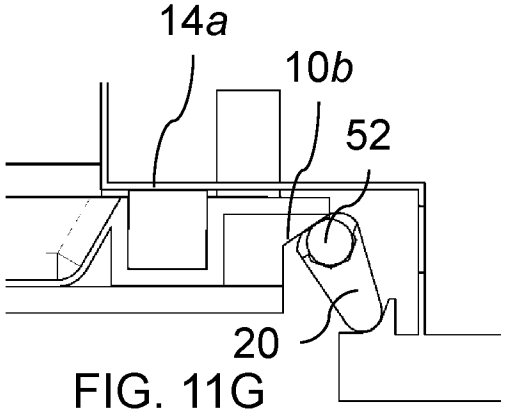
Figure 11H:
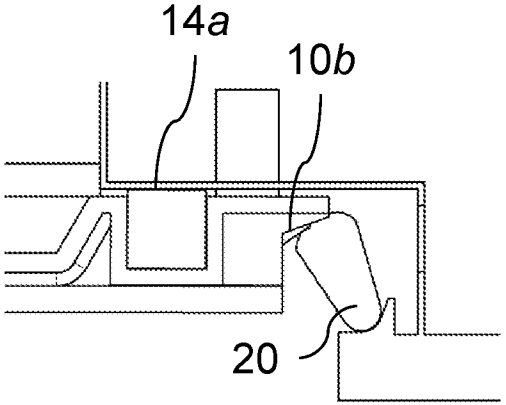

In the event of a blast occurring when abutment block 20 is not fully tightened, the geometry of the angled surface against which roller bearings 52 tighten would in principle tend to push the abutment block to an open position. Nevertheless, most preferably, roller bearings 52 are configured to resiliently retract or collapse rapidly under high load, and the solid abutment surface has a stepped form or is otherwise angled so as to effectively oppose blast forces even when in the non-tightened state of FIG. 11A. FIGS. 11G and 11H illustrate the effect of a blast occurring in the non-tightened state. Specifically, FIG. 11F illustrates the collapse or retraction of roller bearing while FIG. 11G shows how the stepped geometry of the solid abutment surface helps to ensure that even partial overlap of abutment block 20 with abutment surface 10*b* is effective to oppose forces due to a blast.

A further distinction between this embodiment and that of FIG. 3 discussed above relates to the geometry for preventing inward extraction of the panel from the jambs in the event of flexing of the entire panel. In this case, the hinge-side of panel 10 is provided with a projecting lip 42 which engages a step 44 in the recess of the hinge jamb, beyond hinge 16, analogous to the provisions shown in FIG. 3 on the strike jamb side.

Figure 11F:
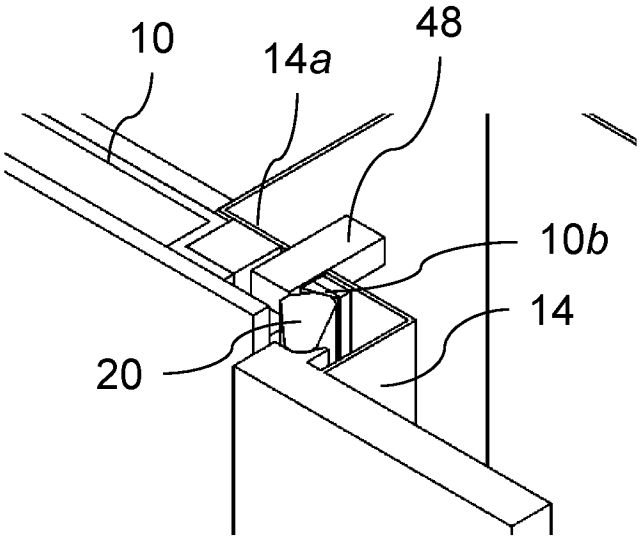

FIGS. 11E and 11F shown sectional and cut-away views, respectively, taken on a further plane to reveal one of a number of spaced-apart pins 48 mounted in strike jamb 14 which engage complementary apertures 50 formed in the edge of panel 10, analogous to the hinge jamb side engagement illustrated in FIG. 3.

Turning now to FIGS. 12A, 12B, 12C, 13A, 13B, 13C, 14A, 14B and 14C, these illustrate schematically a tightening mechanism, mechanically linked to abutment block 20, configured to apply force to the abutment block so as to displace the abutment block beyond the engaged state so as to effect the aforementioned tightening. It should be noted however that a similar mechanism may be used to perform opening, closing and positive locking of other embodiments of the present invention, even where no additional tightening motion is required.

The mechanism shown here provides a manually operable handle 60 which rotates an eccentric linkage, shown here as a disk 62 with a peripheral connection point 64. A spring-loaded piston assembly 66 is mounted between connection point 64 and abutment block 20. Parenthetically, although most preferred embodiments of the invention employ an abutment block 20 extending along a significant proportion of the height of the corresponding dimension of panel 10, the schematic illustration shown here illustrates a localized abutment block 20 for clarity of presentation.

In the position of FIGS. 12A, 12B and 12C, spring-loaded piston assembly 66 is positioned to provide spring-loaded bias to maintain engagement of abutment block 20 with panel abutment surface 10*b* while allowing resilient motion as a latch to permit closing of the panel.

Figure 13B:
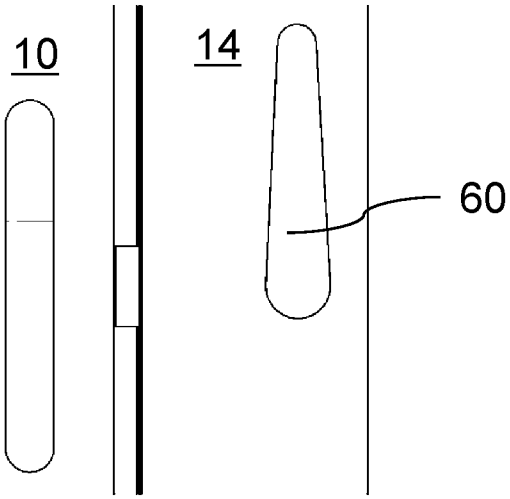
FIGS. 13A, 13B and 13C are views similar to FIGS. 12A, 12B and 12C, respectively, the actuation mechanism being shown in a tightened/locked state.
Figure 13A:
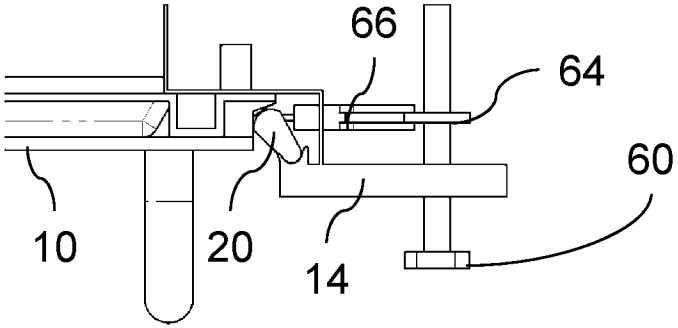
Figure 13C:
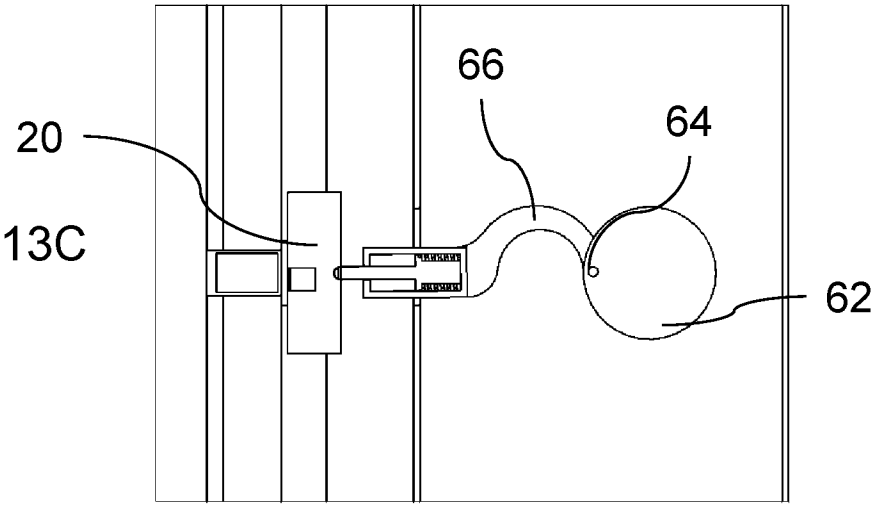

When handle 60 is raised to the state of FIG. 13B, the spring-loaded piston assembly is forced towards abutment block 20 until the free play of the spring bias is used up and abutment block 20 is positively displaced to its tightened position. The alignment of connection point 64 between, or just beyond, the line connecting centers of the handle rotation and the point of connection to the abutment block can be used to provide geometrical locking in this clamped state if required.

When displaced from the position of FIGS. 12A, 12B and 12C in the opposite direction, as illustrated in FIGS. 14A, 14B and 14C, spring-loaded piston assembly draws abutment block 20 to its retracted position, thereby allowing panel 10 to swing to its open position.

Figure 15A:
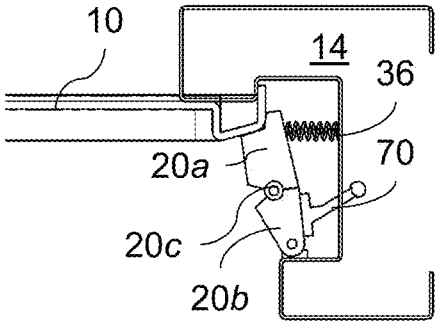
FIGS. 15A, 15B, 15C, 15D, 15E, 15F and 15G are a series of partial horizontal cross-sectional views showing interactions of an articulated abutment block with an edge of the panel and a strike jamb during opening and closing of the panel according to an embodiment of the present invention.
Figure 15B:
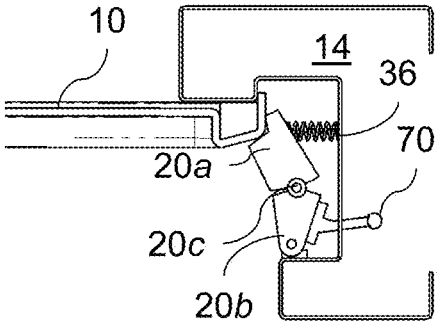
Figure 15C:
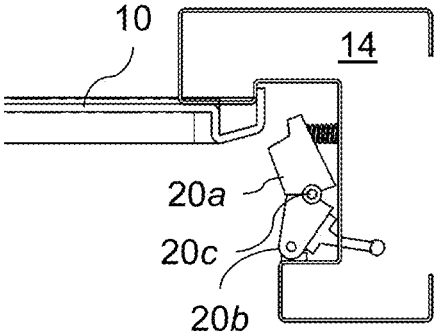
Figure 15D:
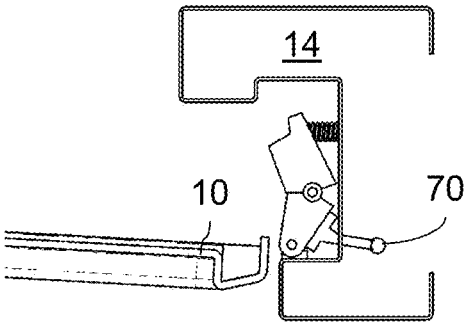
Figure 15F:
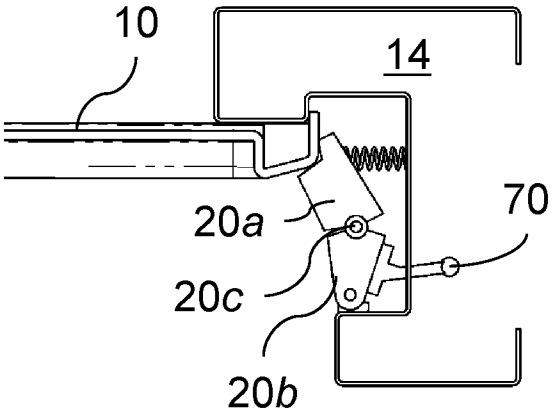
Figure 15E:
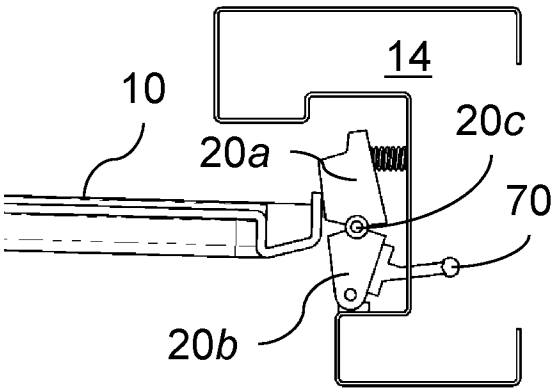
Figure 15G:
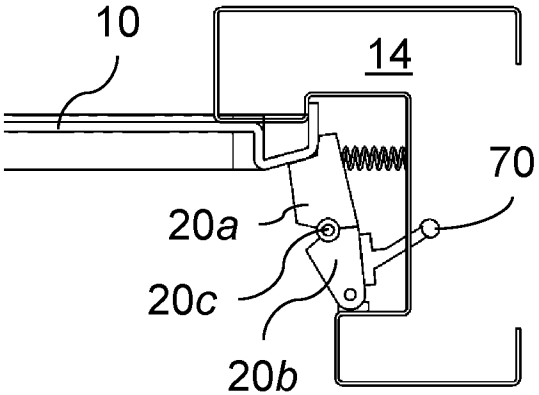

Turning now to FIGS. 15A, 15B, 15C, 15D, 15E, 15F and 15G, this illustrates a further closure, constructed and operative according to an embodiment of the present invention, in which the abutment block is implemented as an articulated abutment block having a first block portion 20*a* and a second block portion 20*b* interconnected at an internal hinge 20*c*. The articulated abutment block is configured and deployed such that, when it assumes an engaged state as shown in FIG. 15F, displacement of internal hinge 20*c* is effective to tighten panel 10 against primary abutment surface 14*a* of strike jamb 14, as shown in FIG. 15G.

FIGS. 15A, 15B, 15C, 15D, 15E, 15F and -15G illustrate a sequence of states during opening and closing of panel 10. FIG. 15A shows an initial locked and tightened state. Displacement of the articulated abutment block is achieved by a suitable actuator mechanism (not shown) that displaces a lever arm 70 integrally formed or rigidly attached to second block portion 20*b*. The initial stage of displacement is effective to move hinge 20*c* and release geometrical locking and clamping of panel 10 against strike jamb 14. Further motion then pivotally displaces the entire articulated abutment block out of the path of swinging motion of panel 10 (FIG. 15C allowing the panel to be swung open (FIG. 15D).

While panel 10 is open and the actuator is released, the articulated abutment block preferably returns under bias of spring 36 to a position similar to that of FIG. 15B in which it provides latch functionality, allowing temporary displacement of the abutment block as it is pushed aside during closing of the panel (FIG. 15E) and then returning the abutment block to the position of FIG. 15F to provide locking of the panel against opening. The geometry of the articulated abutment block is preferably such that effective locking is achieved also in the position of FIG. 15F. Then, on actuation of the actuator to displace lever arm 70, clamped tight closure of the panel is achieved, as shown in FIG. 15G.

Although no actuation mechanism is shown here, it will be appreciated that the actuation mechanism of FIGS. 12A, 12B, 12C, 13A, 13B, 13C, 14A, 14B and 14C is essentially suited to use in this and other embodiments of the invention, merely requiring reorientation of the mechanism as will be clear to one ordinarily skilled in the art.

Figure 17:
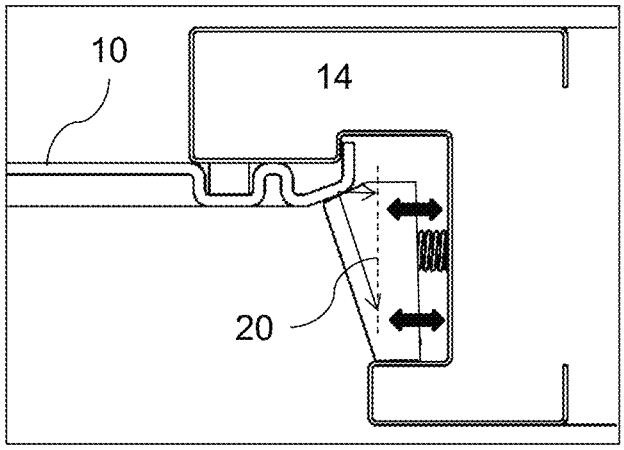
FIG. 17 is a partial, schematic, horizontal cross-sectional view through a further embodiment of the present invention employing a sliding abutment block.

Referring now to FIG. 17, although illustrated above with reference to examples in which displacement of abutment block 20 was performed by pivotal motion, it should be noted that certain embodiments of the invention employ other forms of motion. By way of one non-limiting example, FIG. 17 illustrates and implementation with rectilinear sliding of abutment block 20 between its engaged and retracted positions. Most preferably, the geometry and materials of abutment block 20 and corresponding abutment surfaces 10*b* and 14*b* are chosen such that frictional locking occurs between panel 10, abutment block 20 and strike jamb 14. This ensures that, also in this case, forces on abutment block 20 are essentially compressive only.

Finally, it should be noted that the present invention may be implemented to advantage with a wide range of different panel materials and styles. By way of one non-limiting example, in certain cases, panel 10 may be implemented as a frameless glass panel, such as a glass door. Of particular interest for such an implementation are the various embodiments in which no lock mechanism or latch structure is required to be mounted on the panel, enabling use of a glass panel with a minimum of attached accessories, facilitating manufacture and installation, and maintaining a particularly aesthetically pleasing and elegant effect while achieving effective locking of the panel against forces in two directions.

It will be appreciated that the above descriptions are intended only to serve as examples, and that many other embodiments are possible within the scope of the present invention as defined in the appended claims.

What is claimed is:

1. An apparatus comprising:

(a) an opening bounded by a frame including a hinge jamb, said frame defining a plane of closure;

(b) a panel;

(c) a hinge interconnecting said panel and said hinge jamb and configured to hang said panel relative to said opening so that said panel is swingable about a hinge axis between an open position removed from said opening and a closed position in which said panel is aligned parallel to said plane of closure with a portion of said panel within the opening; and (d) an engagement configuration comprising:

(i) a first engagement feature rigidly integrated with said hinge jamb, said first engagement feature including a first engagement surface oriented substantially perpendicular to said plane of closure, and (ii) a second engagement feature rigidly integrated with said panel, said second engagement feature including a second engagement surface oriented substantially perpendicular to a plane of said panel, said engagement configuration being configured such that said panel swings freely about said hinge axis between said open position and said closed position, and such that, when said panel assumes said closed position, said second engagement surface is brought into overlapping relation with said first engagement surface such that force directed to displace said panel within said plane of closure away from said hinge jamb is opposed by engagement of said second engagement surface with said first engagement surface, and wherein said hinge axis is located between said second engagement feature and said portion of said panel that lies within the opening when said panel is in said closed position when viewed from a direction perpendicular to the plane of closure.

2. The apparatus of claim 1, wherein said first engagement surface is located in a recess of said hinge jamb.

3. The apparatus of claim 1, wherein said first engagement feature comprises a step extending parallel to said hinge axis, and wherein said second engagement feature comprises a projecting lip deployed to engage against said step to oppose forces directed to displace said panel within said plane of closure away from said hinge jamb.

4. The apparatus of claim 3, wherein said projecting lip is formed as an edge of a layer of sheet metal making up at least part of said panel.

* * * * *